US007717389B2

(12) United States Patent
Berman

(10) Patent No.: US 7,717,389 B2
(45) Date of Patent: May 18, 2010

(54) ATTACHABLE HOLDER FOR ITEMS

(76) Inventor: Rod S. Berman, 1900 Avenue of the Stars, 7th Floor, Los Angeles, CA (US) 90067

( * ) Notice: Subject to any disclaimer, the term of this patent is extended or adjusted under 35 U.S.C. 154(b) by 224 days.

(21) Appl. No.: 11/679,743

(22) Filed: Feb. 27, 2007

(65) Prior Publication Data

US 2008/0169400 A1 Jul. 17, 2008

Related U.S. Application Data

(63) Continuation-in-part of application No. 11/623,708, filed on Jan. 16, 2007, which is a continuation-in-part of application No. 11/622,944, filed on Jan. 12, 2007, now abandoned.

(51) Int. Cl.
*A47K 1/08* (2006.01)

(52) U.S. Cl. ..... 248/316.8; 248/918

(58) Field of Classification Search ..... 248/309.1, 248/311.2, 316.8, 918
See application file for complete search history.

(56) References Cited

U.S. PATENT DOCUMENTS

| | | | | |
|---|---|---|---|---|
| 5,074,512 | A | 12/1991 | Gianforcaro | |
| 5,122,941 | A | 6/1992 | Gross | |
| 5,144,290 | A * | 9/1992 | Honda et al. | 345/156 |
| 5,190,387 | A | 3/1993 | Auth | |
| 5,460,347 | A | 10/1995 | Schacher | |
| 5,489,075 | A | 2/1996 | Ible | |
| 5,611,513 | A * | 3/1997 | Rosen | 248/222.11 |
| 5,615,945 | A | 4/1997 | Tseng | |
| 5,762,306 | A | 6/1998 | Day | |
| 5,850,997 | A * | 12/1998 | Rosen | 248/222.11 |
| 5,906,348 | A | 5/1999 | Orenstein | |
| 6,010,104 | A | 1/2000 | Hanson | |
| 6,070,843 | A * | 6/2000 | Rosen | 248/278.1 |
| 6,173,947 | B1 | 1/2001 | Johnson | |
| 6,206,464 | B1 | 3/2001 | Santa Rosa | |
| 6,471,170 | B2 | 10/2002 | Pook | |
| 6,550,737 | B1 | 4/2003 | Sai | |
| 6,672,577 | B2 | 1/2004 | Murvine | |
| 6,749,166 | B2 | 6/2004 | Valentine | |
| 6,799,356 | B2 | 10/2004 | Sanchez | |
| 6,892,875 | B2 | 5/2005 | DeVolpi | |
| 7,004,596 | B2 | 2/2006 | Merrem | |
| 7,483,262 | B2 * | 1/2009 | Yin et al. | 439/131 |
| 2002/0066846 | A1 * | 6/2002 | Giulie et al. | 248/442.2 |
| 2003/0133295 | A1 * | 7/2003 | Merrem | 362/253 |
| 2004/0264170 | A1 | 12/2004 | Merrem | |

OTHER PUBLICATIONS

Photographs (3) of Squirrel Companies, Inc. promotional products, made public at least as early as 2001.

USPTO Office Action dated Mar. 28, 2008, in related U.S. Appl. No. 11/622,944.

(Continued)

*Primary Examiner*—J. Allen Shriver, II
*Assistant Examiner*—Steven M Marsh
(74) *Attorney, Agent, or Firm*—Jeffer Mangels Butler & Marmaro LLP

(57) ABSTRACT

Provided herein is an item holder assembly that includes an attachment mechanism for attaching the assembly to an object such as a laptop computer, an item support or holder, and a member for connecting the attachment mechanism to the item holder or support.

7 Claims, 4 Drawing Sheets

OTHER PUBLICATIONS

USPTO Office Action dated Mar. 28, 2008, in related U.S. Appl. No. 11/623,708.
Response to USPTO Office Action dated Mar. 28, 2008, in related U.S. Appl. No. 11/623,708.
USPTO Office Action dated Sep. 17, 2008, in related U.S. Appl. No. 11/623,708.
USPTO Office Action dated Nov. 17, 2008, in related U.S. Appl. No. 11/623,708.
Preliminary Amendment filed Dec. 17, 2008, in related U.S. Appl. No. 11/623,708.
USPTO Office Action dated Jan. 26, 2009, in related U.S. Appl. No. 11/623,708.
Response to USPTO Office Action dated Jan. 26, 2009, in related U.S. Appl. No. 11/623,708.
Printout of www.belkin.com showing Belkin TraveLite Retractable USB Lamp. This document is believed to have been publicly available more than one year before the filing date of U.S. Appl. No. 11/679,743.
USPTO Office Action dated Nov. 16, 2009, in related U.S. Appl. No. 11/623,708.

* cited by examiner

ATTACHABLE HOLDER FOR ITEMS

RELATED APPLICATION

This application is a continuation in part of U.S. application Ser. No. 11/623,708 entitled IMPROVED ATTACHABLE HOLDER FOR ITEMS filed Jan. 16, 2007, which is a continuation in part of U.S. application Ser. No. 11/622,944 entitled ATTACHABLE HOLDER FOR ITEMS filed Jan. 12, 2007 now abandoned.

FIELD OF THE INVENTION

The present invention relates to attachable holders for items, and illustratively to an apparatus for holding a beverage container (such as a wine glass or soda can) or other items while a person works on a laptop.

SUMMARY OF THE PREFERRED EMBODIMENTS

In accordance with a first preferred aspect of the present invention there is provided an attachable holder assembly that includes an attachment mechanism for attaching the assembly to an object, an item holder, and an extension member connecting the attachment mechanism to the holder. In a preferred embodiment the items holder is a beverage container holder, the extension member is flexible and bendable, and the attachment mechanism comprises a clip. In another preferred embodiment, the assembly is provided in combination with a laptop computer.

In another aspect of the present invention, there is provided a device support assembly for connecting a device to a structure with a port. The assembly can include a first connector on the structure; an extension member; a second connector on the extension member which is compatible with the first connector; and a device, connectable to the extension member opposite the second connector, for use by the user of the structure. Preferably the first connector is a female port on the base of a laptop computer and the second connector is a male plug compatible with the female port. Preferably still, the extension member is a flexible and bendable or collapsible conduit which is sufficiently strong and rigid to support the device and which is bendable or collapsible so that the device can be placed by the user where desired spatially from the laptop computer base. In addition, the device support assembly can include a plurality of extension members, each having an end connected to the second connector, and each having a different device attached thereto. Alternatively, the device support assembly can include a plurality of extension members with each having a connector attached to the same or a different port on the structure, and wherein the device is connected to at least two of the plurality of extension members. This is especially helpful where the device is heavy and needs more than one extension connection to the computer structure to support it.

In yet another embodiment of the present invention, there is provided a first device for connecting to a second device having a holding or supporting function, where the first device is a CPU preferably a laptop computer having female jacks or ports for receiving male plugs from the second device. The second device can include means for supporting or holding an object associated with the male plugs and more preferably attached to, or connected to, or integral with the means for supporting or holding an object.

In yet another preferred embodiment of the present invention, the female jacks or male plugs can be made to snuggly mate so that there is little lateral movement between the plug and jack when the plug is received by the jack, to thereby give greater support to the second device. The plug can also include side extensions which are flush against the side of the laptop adjacent the jack to give further support to the second device.

The present invention also provides a method of supporting an object by using the laptop as the support wherein the object can be supported by the laptop on a plane above the plane of the upper surface of the laptop.

BRIEF DESCRIPTION OF THE DRAWINGS

Like numerals refer to like parts throughout the several views of the drawings.

DESCRIPTION OF THE PREFERRED EMBODIMENTS

Figure 1:
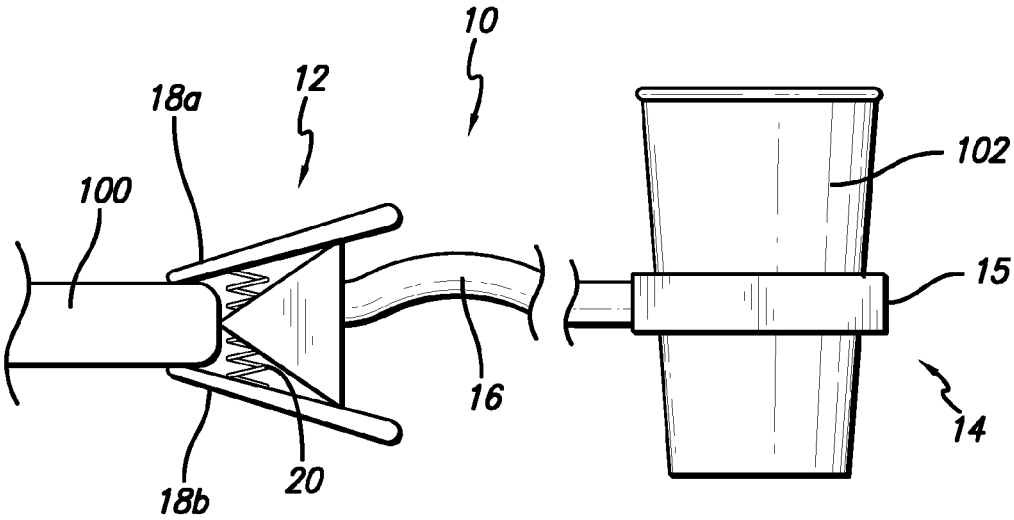
FIG. 1 is a side elevational view of a beverage container holder assembly in accordance with a preferred embodiment of the present invention.

As shown in the drawings, for purposes of illustration, a preferred embodiment of the invention is a beverage container holder assembly 10.

For exemplary purposes only, described hereinbelow is a preferred embodiment wherein the beverage container holder assembly is used with a laptop computer 100. For example, this embodiment would be useful for someone who likes to drink a glass of wine while operating the computer but does not have a convenient place to rest the glass of wine when operating the computer. However, this is not a limitation on the present invention. It will be understood that the beverage container holder assembly can be used on other items.

It will be appreciated that terms such as "front," "back," "top," "rear," "bottom," "side," and "below" used herein are merely for ease of description and refer to the orientation of the components as shown in the figures. It should be understood that any orientation of the beverage container holder assembly, and the components thereof described herein is within the scope of the present invention.

Figure 2:
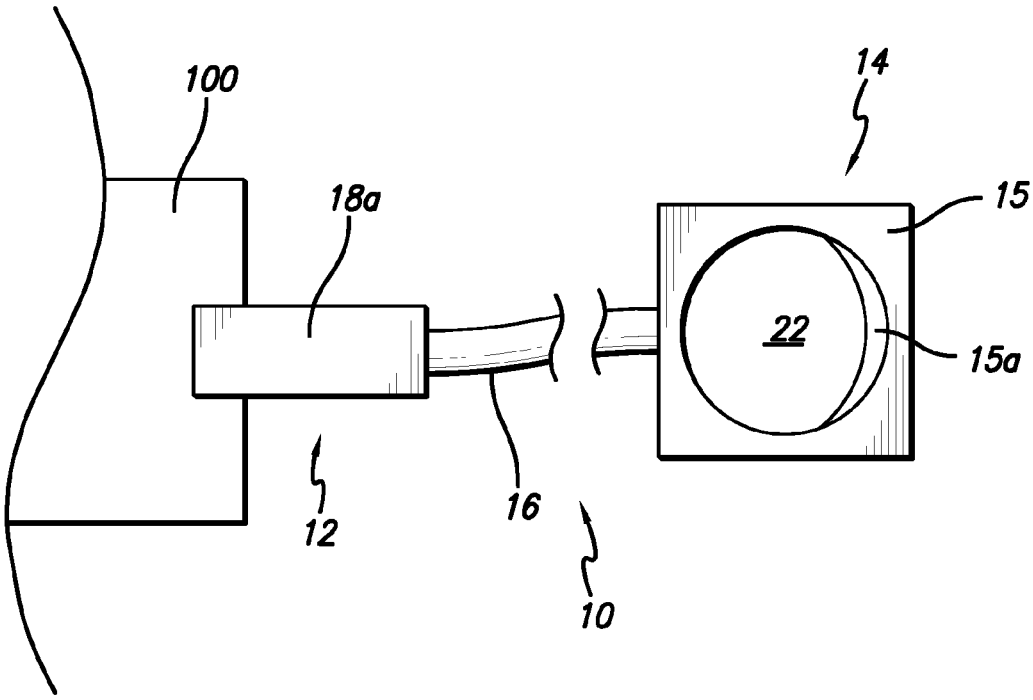
FIG. 2 is a top plan view of the beverage container holder assembly of FIG. 1.
Figure 3:
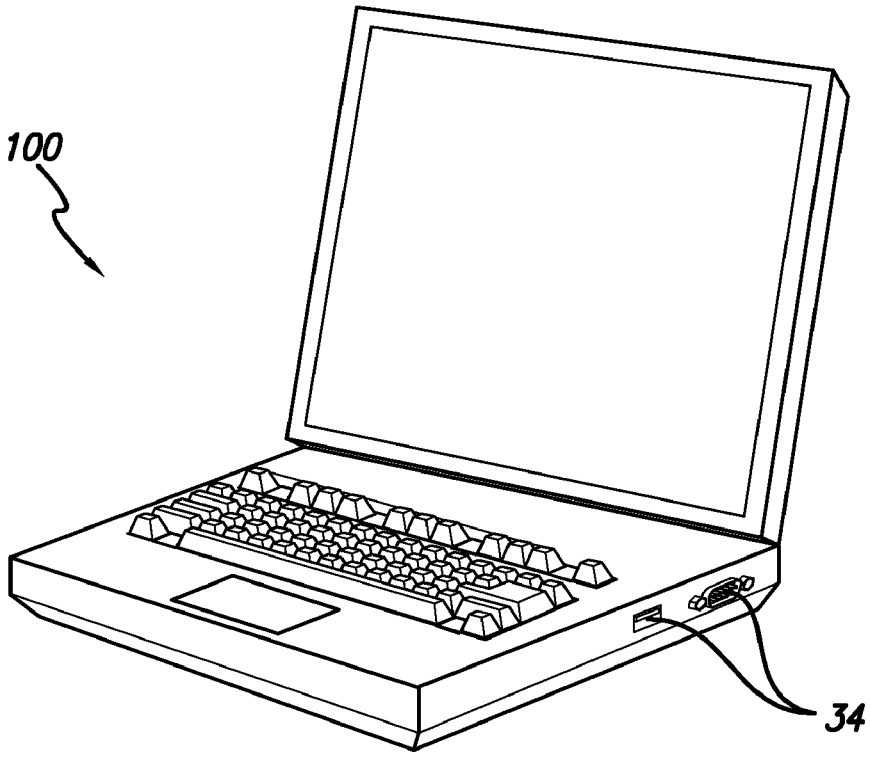
FIG. 3 PRIOR ART
FIG. 3 is a general drawing of a standard prior art laptop computer with female side ports (rear ports not shown).
Figure 4:
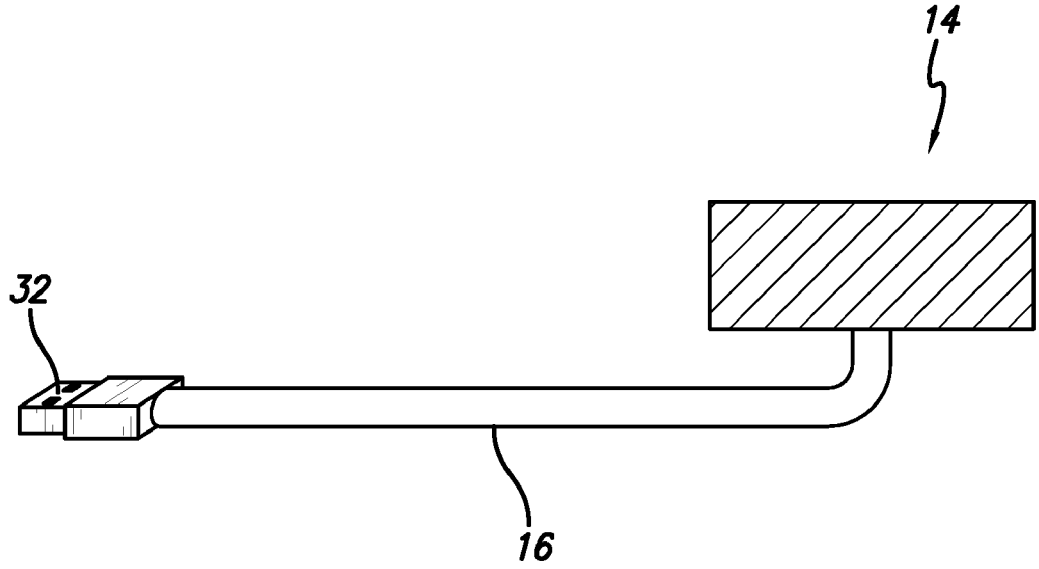
FIG. 4 is another embodiment of the present invention with a male plug at one end of the extension member and a general "box" representing item holders and useable devices.
Figure 5:
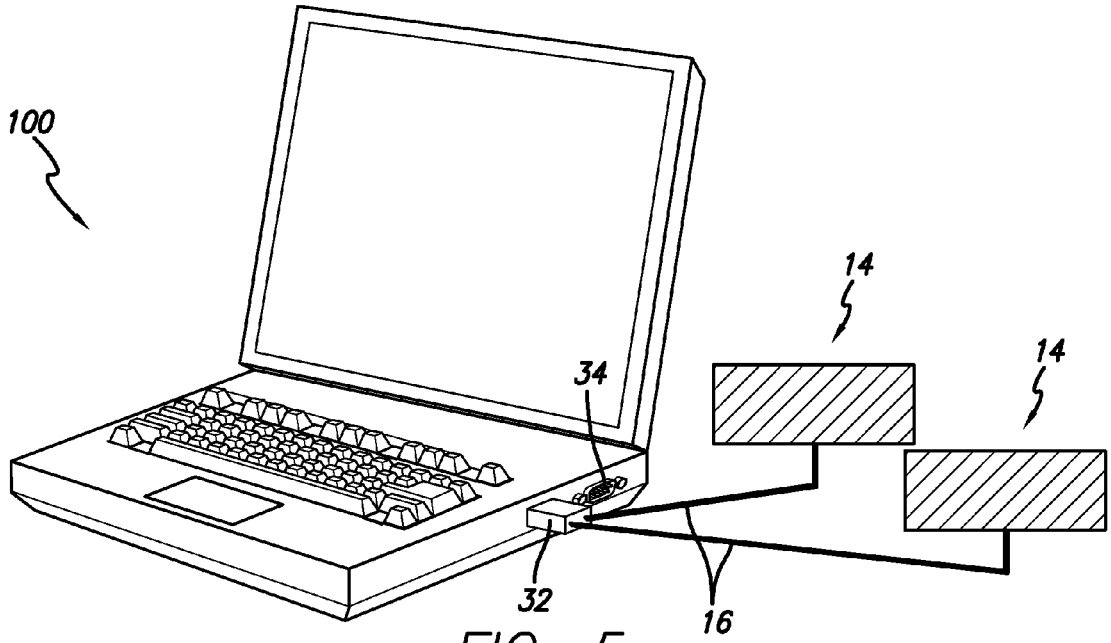
FIG. 5 is yet another embodiment of the present invention showing two extension members extending from a single computer port.
Figure 6:
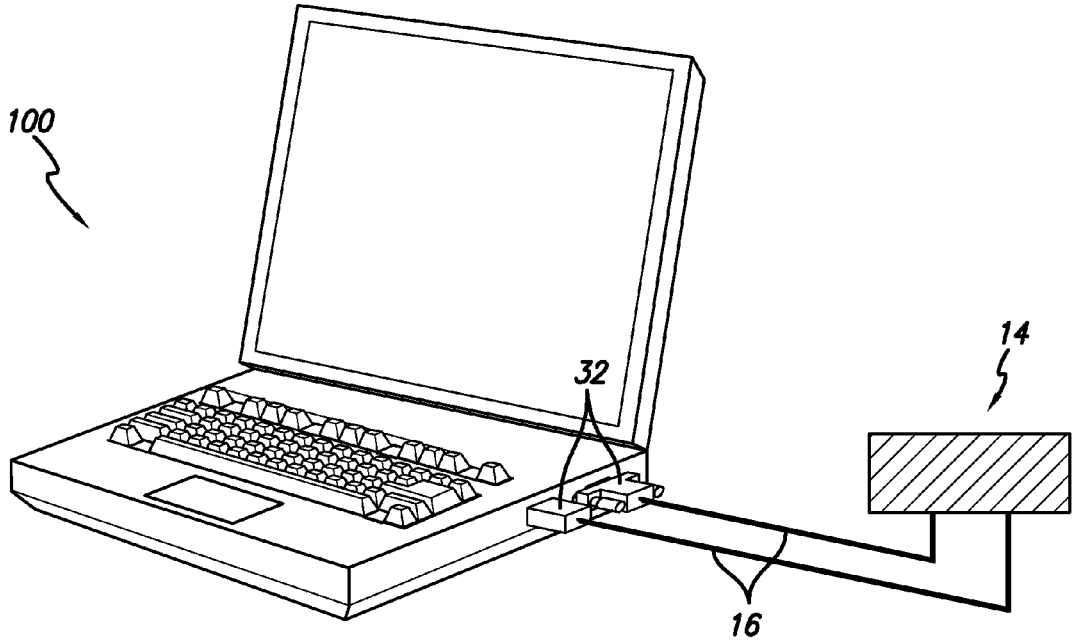
FIG. 6 is another embodiment of the present invention showing two extension members supporting a single item holder or device.

Referring to FIGS. 1-2, the invention is preferably embodied in a beverage container holder assembly 10. The type of beverage container 102 is not a limitation on the present invention. For example, the container 102 can be a cup, can, bottle, etc.

Beverage container holder assembly 10 generally includes an attachment mechanism 12, a beverage container holder 14 and an extension member 16 extending therebetween. In a preferred embodiment, the attachment member 12 is a clip. However, the attachment member 12 can also be a clamp or use other attachment means, such as screws, nuts, bolts, magnetics, etc. Any item that attaches the remaining components of the beverage container holder assembly 10 to a laptop or the like is within the scope of the present invention, provided it is adequate to maintain the attachment while supporting the weight of the holder and the item in the holder.

In an exemplary embodiment where the attachment mechanism 12 is a clip, the clip includes two opposing portions 18*a* and 18*b* that clamp onto the laptop 100. These two opposing portions 18*a* and 18*b* are normally biased in a closed position by a spring 20 or the like. When the distal ends of the clip are moved inwardly, the opposite ends spread apart, thereby allowing the clip to be affixed to the laptop 100.

It will be appreciated by those skilled in the art that the beverage container holder 14 can be any item for holding a beverage container. Many such items are known in the art. Generally, the beverage container holder includes an outer portion 15 that has a container receiving opening 22 defined therethrough. The outer portion 15 does not have to completely surround the opening 24, as long as a beverage container 102 can be supported therein.

In a preferred embodiment, the beverage container holder 14 includes an adjustable portion 15*a* that allows different sized containers 102 to be secured therein. This adjustable portion 15*a* can be spring biased. Example of such holders include those that are used for supporting beverages in automobiles such as BMW automobiles.

With reference to FIGS. 3-6, it will be appreciated by those skilled in the art that the extension member 16 is any component that extends between the attachment mechanism 12 and the beverage container holder 14, thereby allowing the beverage container holder 14 (and the container 102 therein) to extend away from the laptop 102 in a desired spatial relationship. In a preferred embodiment, the extension member 16 is a flexible rubber, plastic or metal (e.g., aluminum) cord, wire or tube or the like that allows the extension member 16 to be adjustable, thereby allowing the beverage container holder 14 to be positioned in a plurality of positions. The flexibility of the extension member can be achieved by a variety of structures known in the art and can be of desired lengths and thicknesses. Preferably, the assembly can be collapsed into a small structure for easy storage and transport and packaging, and it can also be held in a pouch. Preferably the length of the extension member can range from about 2 inches to 24 inches, more preferably 3 inches to 12 inches and even more preferably from 3 inches to 6 inches.

It will also be appreciated that in addition to a beverage container holder, the holder 14 can include a container for holding items, such as, for example, pens, pencils, notepads, snack foods; other electronic devices such as iPods, radios, recorders, cameras, or it can be a tray for supporting any items of use to the user of the thing to which it is attached, such as a laptop 100. The holder 14 can also be attached to the assembly in a manner whereby various different types of holders can be interchanged. Further, a customer could be provided with a kit containing the assembly with various holders 14, sizes of extension members 16 and port connections.

The assembly can also be labeled with a variety of graphics including those of the laptop source or of the item source, so as to function for advertising. For example, the Coca-Cola Company could label the holders with the Coke® mark and thereby be used as a promotion.

In yet another embodiment of the invention, the extension member 16 can be either a flexible or flexible tube, cord, wire, a collapsible and/or foldable structure or the like, with one end having attached thereto a device to be used by the computer operator and the other end having a clip or other means for attaching the extension member to a computer or other structure such as a table. The device can be any type of device of use to the user of the computer or other structure, such as a pencil, scissors, beverage holder, portable fan, etc.

In yet a further embodiment of the invention, the attachment mechanism can be a male component 32 that connects to a corresponding female component or port 34 on the computer 100 or other structure. The computer 100 or other structure can include a female port 34 for receiving the male component 32. The male and female component can be configured to reversibly lock. Alternatively, the extension member 16 can include a male plug 32 that reversibly is received by the existing ports 34 on the structure, for example, the ports 34 on a laptop computer 100. Thus the male plug 32 can include the number of prongs that a standard electrical cord has when plugging into the dial-up, high speed internet or printer ports of a lap top 100. Alternatively, the male connector can be on the structure such as the base of a computer and the female connector can be on the extension member.

In yet still a further embodiment of the invention, the extension member 16 can include an electrical conduit so that the device at the device or holder end 14 of the extension member 16 can be in electrical or data communication with the input port 34 on the computer. In addition, several extension members can be connected to the same connection component that connects to the structure such as the computer such that a single connection to the computer can support a variety of devices.

Figure 7:
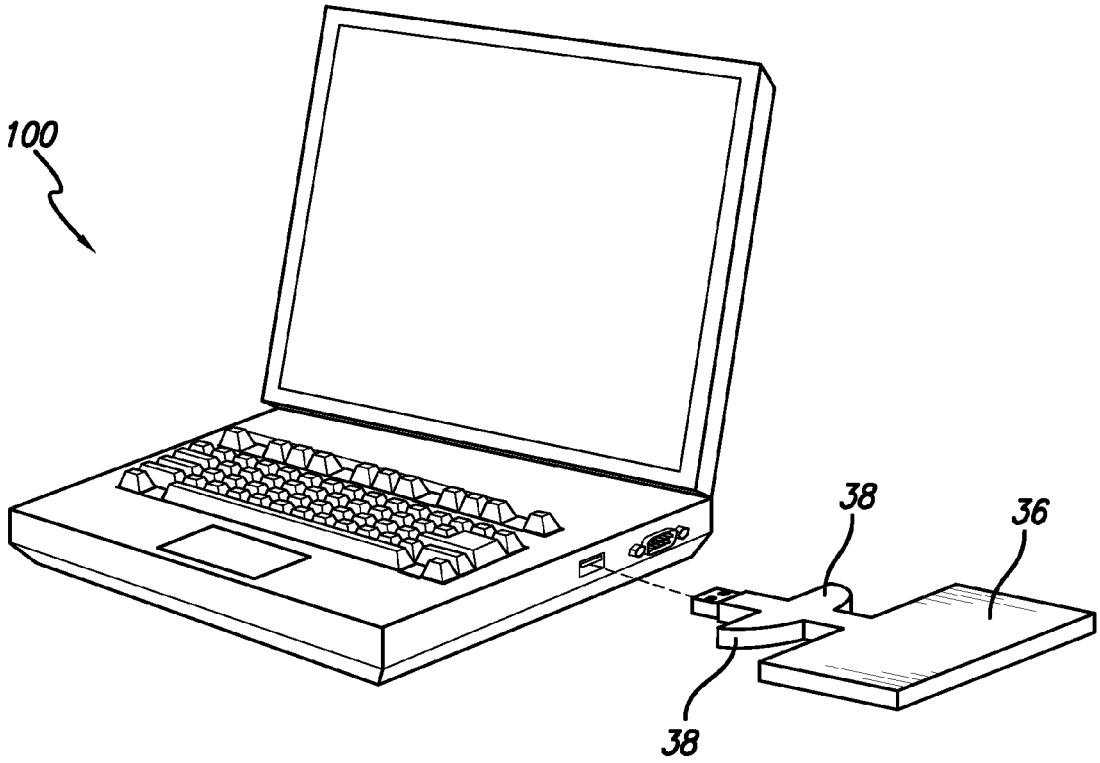
FIG. 7 is an embodiment of the plugs of the present invention showing the side extensions.

In addition to the foregoing, the attachment holder assembly components (attachment mechanism, item holder 14 and extension member 16) may be a unitary structure that simply plugs into the structure (e.g., computer port) or each of the components can be reversibly connectable to each other to thereby facilitate a variety of assemblies with interchangeable parts. For example, the item holder can include a male or female port for reversibly connecting to one end of the attachment mechanism, and with the other end of the attachment mechanism similarly reversibly connectable to the structure port. Moreover, for some applications, for example where the item is to be closely spatially located to the computer, the extension member can be non-bendable and rigid. For example, as shown in FIG. 7, the assembly can include a tray 36 that is connected to the male connector 32 by the extension member 16. It can also include extensions 38.

The foregoing embodiments are merely examples of the present invention. Those skilled in the art may make numerous uses of, and departures from, such embodiments without departing from the spirit and the scope of the present invention. Accordingly, the scope of the present invention is not to be limited to or defined by such embodiments in any way, but rather, is defined solely by the following claims.

What is claimed is:

1. A computer device support assembly comprising an item holder or support, and a connector for securedly connecting the item holder to the computer, wherein the connector comprises a male plug that is configured to be plugged in to a port of the computer, and wherein when the male plug is plugged into a port, the male plug is not configured to be in electrical or data communication with the port of the computer.

2. The computer device support assembly of claim 1 further comprising a pair of extension members extending outwardly from the male plug, wherein the pair of extension members contact a surface of the computer, when the male plug is plugged into a port.

3. A method for supporting objects above the plane formed by the bottom of a laptop computer; the method comprising the steps of:

a. providing a plug which can snuggly fit into the port of a computer, the plug being associated with means for supporting or holding an object;

b. plugging the plug into the port, wherein the plug is not in electrical or data communication with the port; and c. associating the object with the means for supporting or holding the object so that the object is held in spatial place by being at a fixed spatial distance from the laptop.

4. The computer device support assembly of claim 1 wherein the male plug and the item holder or support are oriented generally along the same horizontally oriented plane when the male plug is plugged into a port on the computer.

5. The computer device support assembly of claim 4 wherein the item holder or support is a tray.

6. The computer device support assembly of claim 4 wherein the male plug and the item holder or support include a rigid connection member therebetween, and wherein the rigid connection member, male plug and the item holder or support are oriented generally along the same plane.

7. A computer device support assembly comprising an item holder or support, and a connector for securedly connecting the item holder to the computer, wherein the connector comprises a male plug that configured to plugged in to a port of the computer, and wherein when the male plug is plugged into a port, the male plug is not configured to be in electrical or data communication with the power source of the computer.

* * * * *